US010488031B2

(12) United States Patent
Das et al.

(10) Patent No.: US 10,488,031 B2
(45) Date of Patent: Nov. 26, 2019

(54) HEAT SINKS FOR LIGHT FIXTURES

(71) Applicant: Eaton Intelligent Power Limited, Dublin (IE)

(72) Inventors: Alok Das, Pune (IN); Anzar Pandurang Rade, Pune (IN); Omkar Bharat Jadhav, Pune (IN); Siddhartha Satya Saladi, Pune (IN); Matthew Allan Canales, Peachtree City, GA (US); Sanjeev Bhimasenrao Kulkarni, Hubballi-Dharwad (IN); Christopher Lee Bohler, Peachtree City, GA (US); Arnab Guha, Pune (IN)

(73) Assignee: Eaton Intelligent Power Limited, Dublin (IE)

( * ) Notice: Subject to any disclaimer, the term of this patent is extended or adjusted under 35 U.S.C. 154(b) by 0 days.

(21) Appl. No.: 15/972,923

(22) Filed: May 7, 2018

(65) Prior Publication Data

US 2018/0320879 A1 Nov. 8, 2018

Related U.S. Application Data

(60) Provisional application No. 62/502,228, filed on May 5, 2017.

(51) Int. Cl.

| | |
|---|---|
| ***F21V 29/75*** | (2015.01) |
| ***F21V 29/71*** | (2015.01) |
| ***F21V 29/503*** | (2015.01) |
| ***F21V 29/51*** | (2015.01) |
| ***F21V 29/87*** | (2015.01) |
| ***F21V 29/85*** | (2015.01) |
| *F21Y 115/10* | (2016.01) |

(52) U.S. Cl.

CPC ..... *F21V 29/75* (2015.01); *F21V 29/503* (2015.01); *F21V 29/51* (2015.01); *F21V 29/71* (2015.01); *F21V 29/85* (2015.01); *F21V 29/87* (2015.01); *F21Y 2115/10* (2016.08)

(58) Field of Classification Search

None

See application file for complete search history.

(56) References Cited

U.S. PATENT DOCUMENTS

| | | | | |
|---|---|---|---|---|
| 2004/0118579 | A1* | 6/2004 | McCutcheon | F28D 15/0241 174/16.3 |
| 2014/0224466 | A1* | 8/2014 | Lin | B82Y 30/00 165/185 |
| 2014/0268768 | A1* | 9/2014 | Holland | F21K 9/20 362/249.02 |
| 2016/0010804 | A1* | 1/2016 | Barnetson | F21K 9/232 362/235 |
| 2016/0091193 | A1* | 3/2016 | Cai | F21K 9/232 362/235 |
| 2016/0143189 | A1* | 5/2016 | Campbell | H05K 7/20436 165/185 |
| 2017/0307204 | A1* | 10/2017 | Cattoni | F21S 8/036 |
| 2018/0252402 | A1* | 9/2018 | Parameshwara | F21V 5/048 |

* cited by examiner

*Primary Examiner* — Ashok Patel

(74) *Attorney, Agent, or Firm* — King & Spalding LLP

(57) ABSTRACT

A heat sink assembly for a light fixture can include at least one heat sink fin disposed in thermal communication with at least one heat-generating component of the light fixture, where the at least one heat sink fin includes a thermoplastic material. The at least one heat sink fin can absorb and dissipate sufficient heat to comply with applicable industry standards for the light fixture.

20 Claims, 14 Drawing Sheets

HEAT SINKS FOR LIGHT FIXTURES

This application claims priority under 35 U.S.C. § 119 to U.S. Provisional Patent Application Ser. No. 62/502,228, titled "Heat Sinks For Light Fixtures" and filed on May 5, 2017, the entire contents of which are hereby incorporated herein by reference.

TECHNICAL FIELD

Technical Field

Embodiments described herein relate generally to light fixtures, and more particularly to systems, methods, and devices for regulating temperatures of light fixtures using heat sinks.

Background

Light fixtures can have one or more components (e.g., light sources, power supply (e.g., driver), controller) that generate heat during use. If this heat is not dissipated effectively, damage can be caused to those heat-generating components and/or to other components (e.g., housing, printed circuit board) of a light fixture. Such damage can cause the light fixture to suffer from diminished performance or even failure.

SUMMARY

In general, in one aspect, the disclosure relates to a heat sink assembly for a light fixture. The heat sink assembly can include at least one heat sink fin disposed in thermal communication with at least one heat-generating component of the light fixture, where the at least one heat sink fin includes a thermoplastic material. The at least one heat sink fin absorbs and dissipates sufficient heat to comply with applicable industry standards for the light fixture.

These and other aspects, objects, features, and embodiments will be apparent from the following description and the appended claims.

BRIEF DESCRIPTION OF THE DRAWINGS

The drawings illustrate only example embodiments of heat sinks for light fixtures and are therefore not to be considered limiting of its scope, as heat sinks for light fixtures may admit to other equally effective embodiments. The elements and features shown in the drawings are not necessarily to scale, emphasis instead being placed upon clearly illustrating the principles of the example embodiments. Additionally, certain dimensions or positions may be exaggerated to help visually convey such principles. In the drawings, reference numerals designate like or corresponding, but not necessarily identical, elements.

DETAILED DESCRIPTION OF EXAMPLE EMBODIMENTS

Figure 1A:
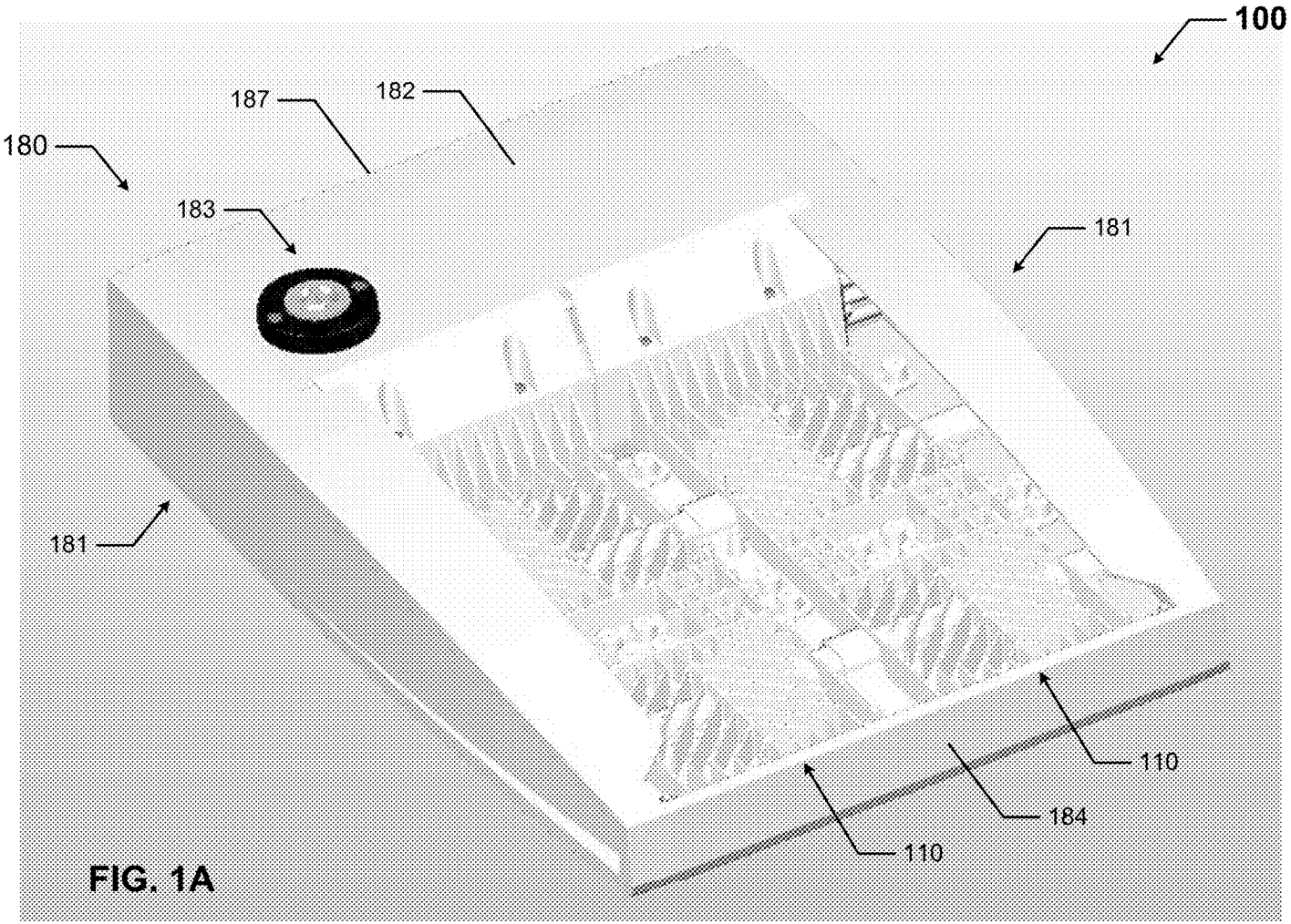
FIGS. 1A and 1B show a top-side perspective view and a bottom-side perspective view, respectively, of a light fixture in accordance with certain example embodiments.

The example embodiments discussed herein are directed to systems, methods, and devices for light fixtures with heat sinks. While example embodiments of heat sinks are described herein as being used with light fixtures, example embodiments can alternatively be used with any of a number of other electrical devices (or components thereof), including but not limited to controllers, variable frequency drives (VFDs), stereo equipment, and circuit board assemblies.

Example embodiments can be used with light fixtures located in any environment (e.g., indoor, outdoor, hazardous, non-hazardous, high humidity, low temperature, corrosive, sterile, high vibration). Further, light fixtures described herein can use one or more of a number of different types of light sources, including but not limited to light-emitting diode (LED) light sources, fluorescent light sources, organic LED light sources, incandescent light sources, and halogen light sources. Therefore, light fixtures described herein, even in hazardous locations, should not be considered limited to a particular type of light source.

A user may be any person that interacts with a light fixture. Examples of a user may include, but are not limited to, an engineer, an electrician, an instrumentation and controls technician, a mechanic, an operator, a consultant, a contractor, an asset, a network manager, and a manufacturer's representative. Example heat sinks described herein can be made of one or more of a number of materials, including but not limited to thermoplastic, copper, aluminum, rubber, stainless steel, and ceramic.

In certain example embodiments, light fixtures having example heat sinks are subject to meeting certain standards and/or requirements. For example, the National Electric Code (NEC), the National Electrical Manufacturers Association (NEMA), the International Electrotechnical Commission (IEC), the Federal Communication Commission (FCC), and the Institute of Electrical and Electronics Engineers (IEEE) set standards as to electrical enclosures (e.g., light fixtures), wiring, and electrical connections. As another example, Underwriters Laboratories (UL) sets various standards for light fixtures, including standards for heat dissipation. Use of example embodiments described herein meet (and/or allow a corresponding device to meet) such standards when required. In some (e.g., PV solar) applications, additional standards particular to that application may be met by the electrical enclosures using example heat sinks described herein.

Any light fixtures, or components thereof (e.g., example heat sinks), described herein can be made from a single piece (e.g., as from a mold, injection mold, die cast, 3-D printing process, extrusion process, stamping process, or other prototype methods). In addition, or in the alternative, a light fixture (or components thereof) can be made from multiple pieces that are mechanically coupled to each other. In such a case, the multiple pieces can be mechanically coupled to each other using one or more of a number of coupling methods, including but not limited to epoxy, welding, fastening devices, compression fittings, mating threads, and slotted fittings. One or more pieces that are mechanically coupled to each other can be coupled to each other in one or more of a number of ways, including but not limited to fixedly, hingedly, removeably, slidably, and threadably.

Components and/or features described herein can include elements that are described as coupling, fastening, securing, abutting, or other similar terms. Such terms are merely meant to distinguish various elements and/or features within a component or device and are not meant to limit the capability or function of that particular element and/or feature. For example, a feature described as a "coupling feature" can couple, secure, fasten, abut, and/or perform other functions aside from merely coupling.

A coupling feature (including a complementary coupling feature) as described herein can allow one or more components and/or portions of an example heat sink or other component of a light fixture to become coupled, directly or indirectly, to another portion of the example heat sink or other component of a light fixture. A coupling feature can include, but is not limited to, a snap, Velcro, a clamp, a portion of a hinge, an aperture, a recessed area, a protrusion, a slot, a spring clip, a tab, a detent, and mating threads. One portion of an example heat sink can be coupled to a light fixture by the direct use of one or more coupling features.

In addition, or in the alternative, a portion of an example heat sink can be coupled to a light fixture using one or more independent devices that interact with one or more coupling features disposed on a component of the heat sink. Examples of such devices can include, but are not limited to, a pin, a hinge, a fastening device (e.g., a bolt, a screw, a rivet), epoxy, glue, adhesive, tape, and a spring. One coupling feature described herein can be the same as, or different than, one or more other coupling features described herein. A complementary coupling feature (also sometimes called a corresponding coupling feature) as described herein can be a coupling feature that mechanically couples, directly or indirectly, with another coupling feature.

If a component of a figure is described but not expressly shown or labeled in that figure, the label used for a corresponding component in another figure can be inferred to that component. Conversely, if a component in a figure is labeled but not described, the description for such component can be substantially the same as the description for the corresponding component in another figure. The numbering scheme for the various components in the figures herein is such that each component is a three digit number and corresponding components in other figures have the identical last two digits. For any figure shown and described herein, one or more of the components may be omitted, added, repeated, and/or substituted. Accordingly, embodiments shown in a particular figure should not be considered limited to the specific arrangements of components shown in such figure.

Further, a statement that a particular embodiment (e.g., as shown in a figure herein) does not have a particular feature or component does not mean, unless expressly stated, that such embodiment is not capable of having such feature or component. For example, for purposes of present or future claims herein, a feature or component that is described as not being included in an example embodiment shown in one or more particular drawings is capable of being included in one or more claims that correspond to such one or more particular drawings herein.

Example embodiments of heat sinks used in light fixtures will be described more fully hereinafter with reference to the accompanying drawings, in which example embodiments of heat sinks used in light fixtures are shown. Heat sinks used in light fixtures may, however, be embodied in many different forms and should not be construed as limited to the example embodiments set forth herein. Rather, these example embodiments are provided so that this disclosure will be thorough and complete, and will fully convey the scope of heat sinks used in light fixtures to those or ordinary skill in the art. Like, but not necessarily the same, elements (also sometimes called components) in the various figures are denoted by like reference numerals for consistency.

Terms such as "first", "second", "top", "bottom", "side", "distal", "proximal", and "within" are used merely to distinguish one component (or part of a component or state of a component) from another. Such terms are not meant to denote a preference or a particular orientation, and are not meant to limit embodiments of heat sinks used in light fixtures. In the following detailed description of the example embodiments, numerous specific details are set forth in order to provide a more thorough understanding of the invention. However, it will be apparent to one of ordinary skill in the art that the invention may be practiced without these specific details. In other instances, well-known features have not been described in detail to avoid unnecessarily complicating the description.

Figure 1B:
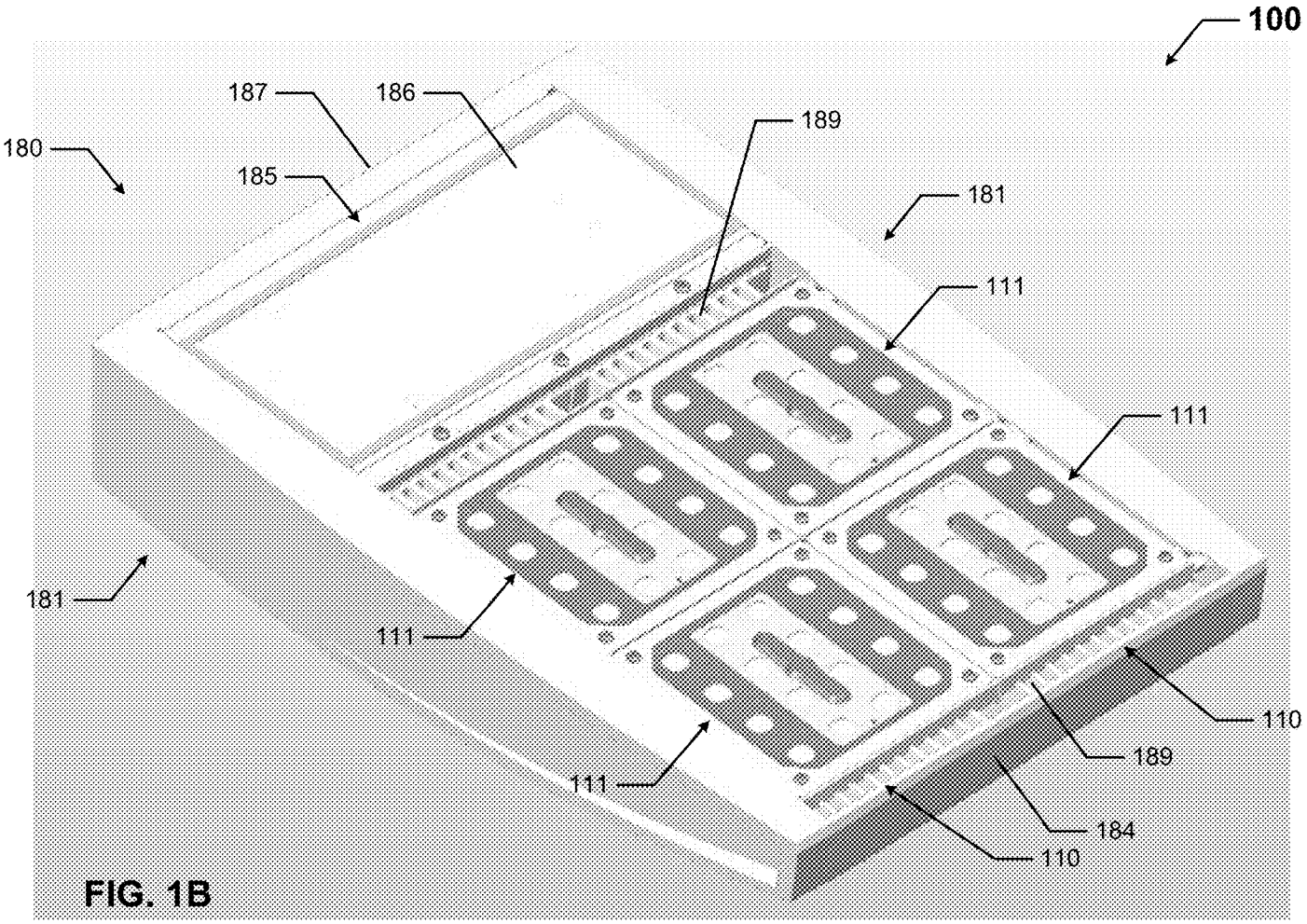

FIGS. 1A and 1B show a top-side perspective view and a bottom-side perspective view, respectively, of a light fixture 100 in accordance with certain example embodiments. The light fixture 100 of FIGS. 1A and 1B has a number of components. For example, in this case, the light fixture 100 includes a housing 180, a sensor device 183 mounted on the housing 180, and a lighting assembly 110 mounted, at least in part, within the housing 180. The housing 180 includes a distal end 184, a proximal end 187, a power supply housing 185 disposed adjacent to the proximal end 187 of the housing 180, and two end caps 181 enclosing either side of the housing 180 adjacent to the distal end 184 and the proximal end 187.

The power supply housing 185 is defined, at least in part, by a top surface 182 and a bottom surface 186. The sensor device 183 in this case is disposed atop the top surface 182 of the power supply housing 185. The lighting assembly 110 is disposed between the two end caps 181, the power supply housing 185, and the distal end 184 of the housing 180. The power supply housing 185 is designed to house a power supply (e.g., a LED driver, a ballast) that includes one or more of a number of components that provide power to some or all other components (e.g., the lighting panels 111) of the light fixture 100. Examples of such components of the power supply housing 185 can include, but are not limited to, a diode, a capacitor, an inductor, a transformer, a resistor, a transistor, an integrated circuit, and a fuse.

The lighting assembly 110 includes two example heat sink assemblies 120, coupled to each other side-by-side, and a number (in this case, four) lighting panels 111 coupled thereto. Specifically, two lighting panels 111 are coupled to one of the heat sink assemblies 120, and the other two lighting panels 111 are coupled to the other heat sink assembly 120. When the lighting assembly 110 is coupled to the housing 180, the lighting panels 111 are exposed to an aperture in the bottom side of the housing 180, allowing light emitted by the light sources of the lighting panels 111 to projected outward from the light fixture 100.

A lighting panel 111 can include one or more of a number of different components, some of which can be heat-generating. Examples of such components can include, but are not limited to, a light source, a circuit board, an integrated circuit, an electrical conductor, a capacitor, a resistor, a diode, an inductor, and an opto-coupler. Each lighting panel 111 can use power provided by a power supply of the light fixture 100 and use that power to emit light.

The lighting assembly 110 in this case has a number of air gaps 189 (part of the heat sink assemblies 120) disposed proximate to the distal end 184 of the housing 180 and adjacent to the power supply housing 185. These air gaps 189 allow for air to flow therethrough (as through natural convection) to help dissipate heat accumulated by the heat sink assembly 120 and/or other components (e.g., the power supply housing 185) of the light fixture 100 that generate and/or retain heat. More details of the heat sink assembly 120 are provided below with respect to FIGS. 2A-2D.

Figure 2A:
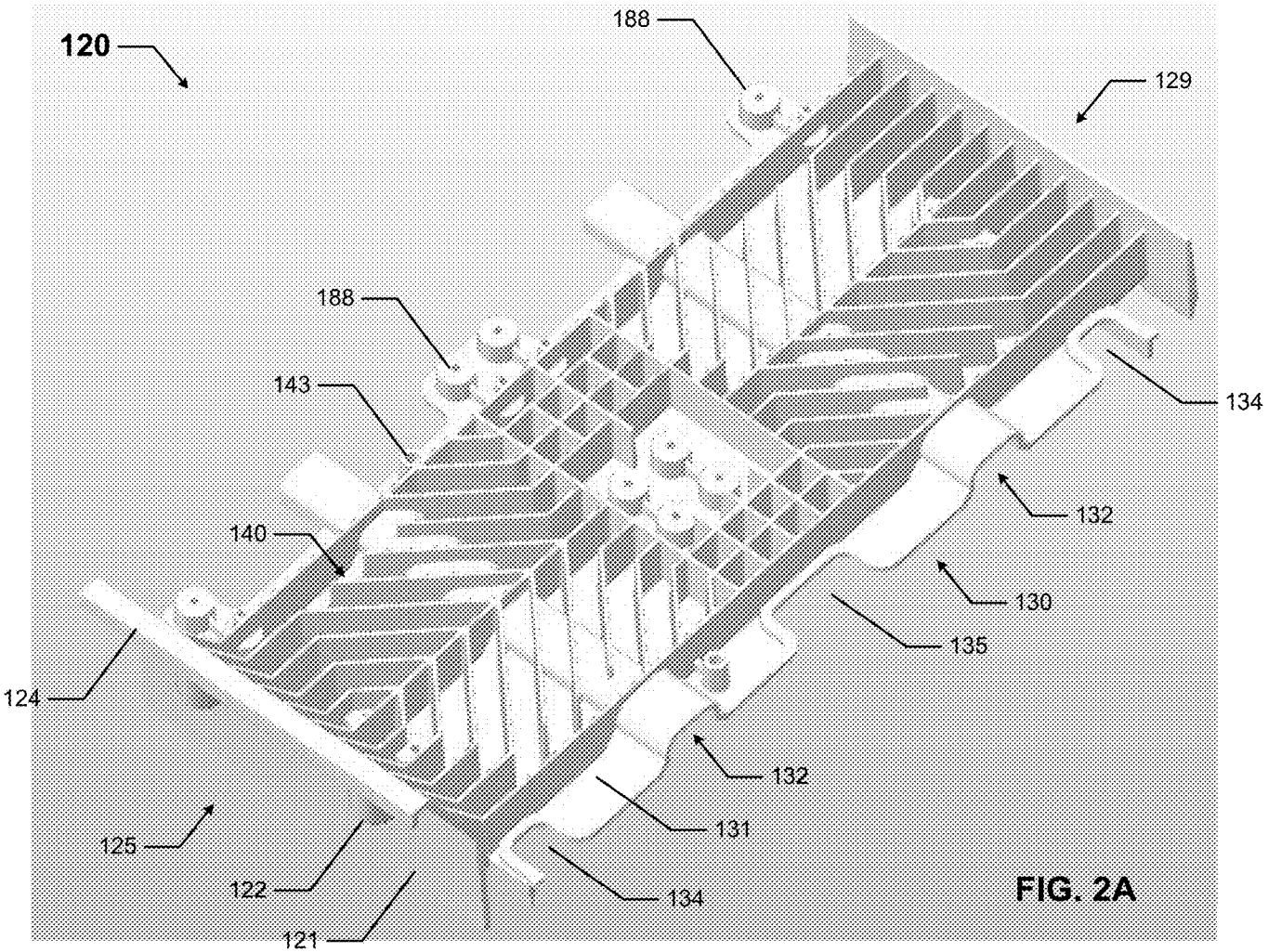
FIGS. 2A-2D show various views of a heat sink assembly in accordance with certain example embodiments.
Figure 2B:
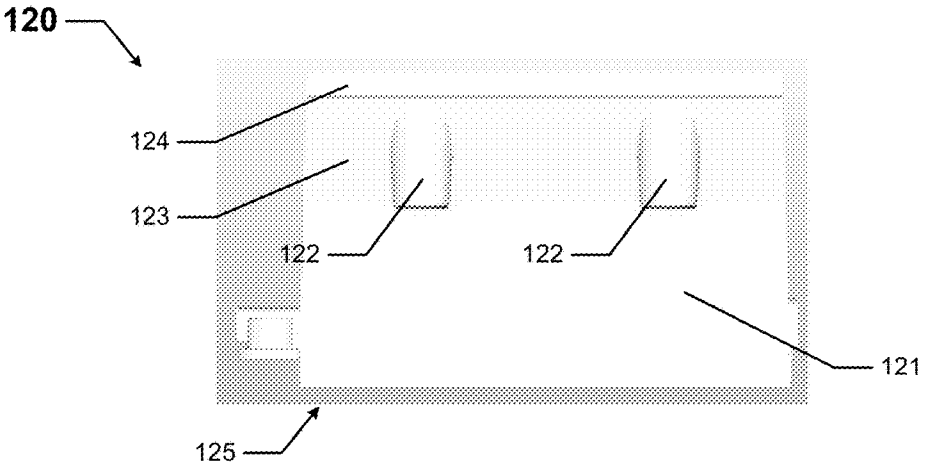
Figure 2C:
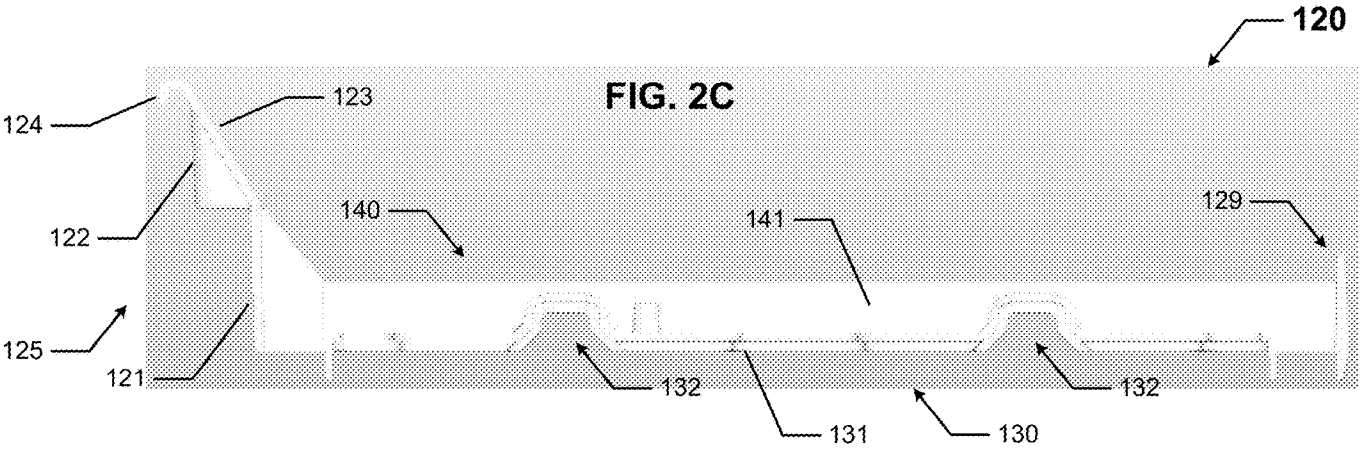
Figure 2D:
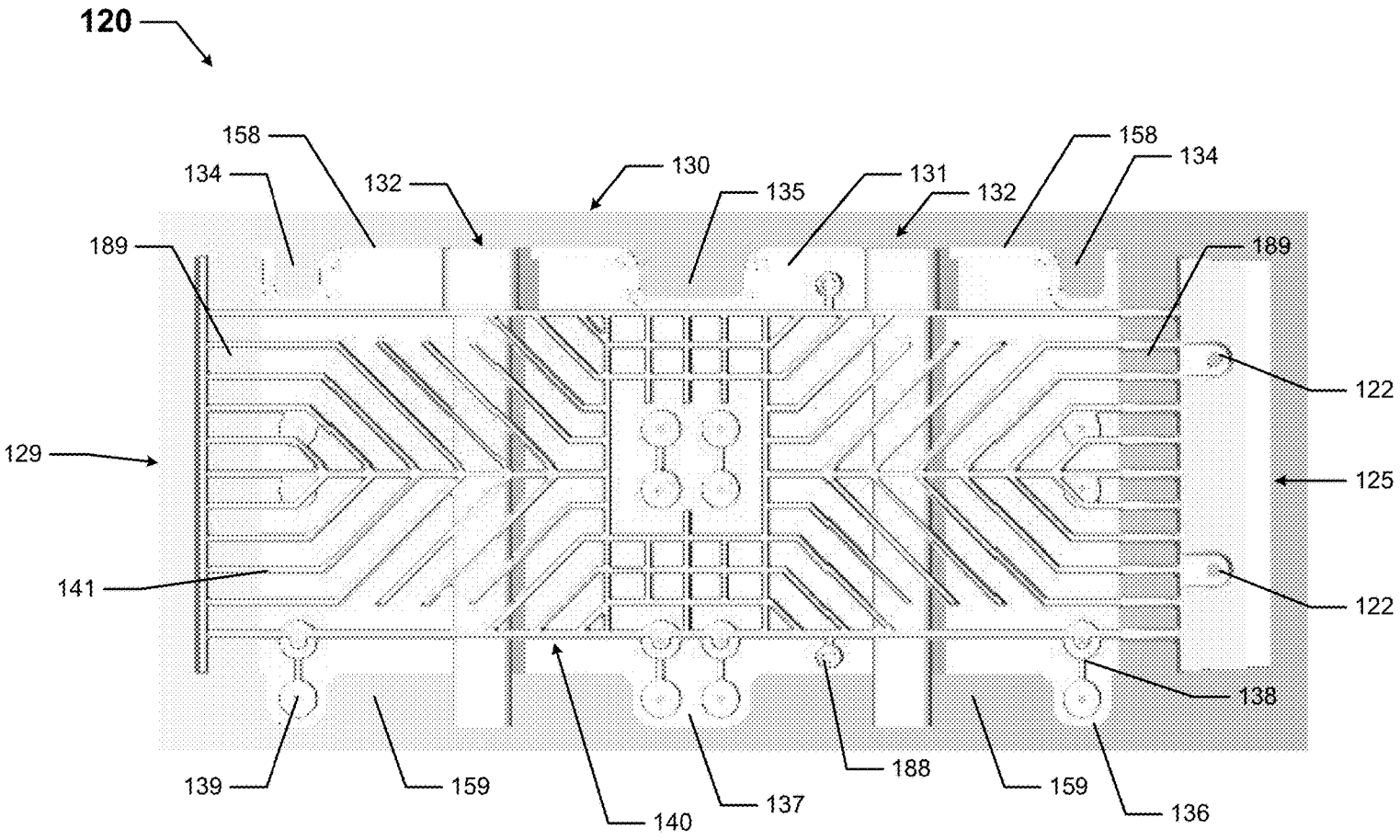

FIGS. 2A-2D show various views of a heat sink assembly 120 of FIGS. 1A and 1B in accordance with certain example embodiments. Specifically, FIG. 2A shows a top-side perspective view of the heat sink assembly 120. FIG. 2B shows a front view of the heat sink assembly 120. FIG. 2C shows a side view of the heat sink assembly 120. FIG. 2D shows a top view of the heat sink assembly 120. Referring to FIGS. 1A-2D, The example heat sink assembly 120 of FIGS. 2A-2D can include one or more of a number of components having one or more of a number of configurations. For example, in this case, the heat sink assembly 120 includes a base 130, heat sink fins 140, a proximal end 125, and a distal end 129.

There can be any number of heat sink fins 140 of the heat sink assembly 120. Each heat sink fin 140 has a body 141. Further, when there are multiple heat sink fins 140 of the heat sink assembly 120, the shape and size of the body 141 of one of the heat sink fins 140 can be the same as, or different than, the shape and size of the body 141 of one or more of the other heat sink fins 140. For example, in this case, there is a single heat sink fin 140 having a number of branches that spans between the proximal end 125 and the distal end 129. The configuration of the body 141 of the heat sink fin 140 is substantially symmetrical around an axis halfway between and parallel to the proximal end 125 and the distal end 129.

There are many other configurations that the heat sink fins 140 of a heat sink assembly 120 can have. As an example, the height of the body 141 of each of the heat sink fins 140 can be relatively short. Further, while the outer-most heat sink fins 140 of the heat sink assembly 120 can be planar, most of the rest of the heat sink fins 140 have varying three-dimensional shapes to form an aero design when viewed from above. As another example, the top- and bottom-most heat sink fins 140 can be planar, and all of the other heat sink fins 140 of the heat sink assembly 120 are curved three-dimensional shapes to form a peacock design when viewed from above. As yet another example, all of the heat sink fins 140 of the heat sink assembly 120 can be vertical protrusions that extend away from the base 130, giving the appearance of pins when viewed from above.

In certain example embodiments, the body 141 of one or more heat sink fins 140 can include one or more coupling features 143. In this case, each coupling feature 143 is an aperture that extends along the height of the body 141 of the heat sink fin 140. As such, these coupling features 143 can be used to receive a fastening device (e.g., a screw, a bolt, a rivet) that further couples to the base 130 (discussed in more detail below), thereby securing the heat sink fin 140 to the base 130 of the heat sink assembly 120. In some cases, the coupling features 143 of the base 130 can also serve as an electrically-conductive terminal 139.

As discussed above, the body 141 of the heat sink fin 140 can be made from one or more of a number of materials. In the current art, the body of a heat sink fin is made exclusively of aluminum or some other type of metal. In such cases, there are often multiple heat sink fins that are arranged in parallel to each other. The reason for this is that such metals have good thermal conductance. Some down sides of using such metals for the body 141 of a heat sink fin 140 is an increase in weight, an increase in cost, and a need to make the heat sink fins 140 electrically non-conductive to avoid a fault, a short, and/or any other adverse electrical condition.

The body 141 of the heat sink fin 140 used in example heat sink assemblies 120, such as in FIGS. 2A-2D, is different. Specifically, the body 141 of the heat sink fins 140 in example heat sink assemblies 120 are made, at least in part, of a thermoplastic (also called a polymeric material). Thermoplastic as defined herein is a material that is a thermally conductive plastic. Thermoplastic material can be created in one or more of a number of ways. For example, laser direct structuring (LDS), which is a process that utilizes a laser source to activate electrically-conductive circuit areas on thermally-conductive plastic, and those circuit areas are subsequently metallized. As another example, a thick film manufacturing process can be used to print electrically-conductive circuits directly to thermally-conductive polymers. Such a process is somewhat similar to low temperature co-fired ceramic printing, but modified to be applied to plastic. As another example, example heat sinks can be designed in accordance with in-plane and through plane thermal conductivity properties by controlling gate location, controlling mold flow parameters, and selection of additive material.

In some cases, the thermoplastic can have integrated therein one or more of a number of electrically-conductive materials (e.g., copper, aluminum). In such a case, the electrically-conductive material would be discretely integrated with the body 141 of a heat sink fin 140. In other words, the electrically-conductive material would not be integrated throughout the body 141, but rather would only be located along certain sections. This would allow for the flow of electricity through the electrically-conductive material without compromising the thermal requirements of the heat sink fins 140 and without posing a risk of an adverse electrical condition (e.g., fault).

The body 141 of the heat sink fin 140 is coupled to the distal end 129 of the heat sink assembly 120. The distal end 129 of the heat sink assembly 120 can be used to help frame the heat sink assembly 120 so that the heat sink assembly 120 can be properly disposed within the housing 180 of the light fixture 100. In this case, the distal end 129 of the heat sink assembly 120 is a planar piece that is disposed substantially perpendicular to the adjoining part of the body 141 of the heat sink fin 140.

The body 141 of the heat sink fin 140 is also coupled to the proximal end 125 of the heat sink assembly 120. The proximal end 125 of the heat sink assembly 120 can be used to help frame the heat sink assembly 120 so that the heat sink assembly 120 can be properly disposed within the housing 180 of the light fixture 100. In this case, the proximal end 125 of the heat sink assembly 120 includes a number of features that are disposed substantially perpendicular to the adjoining part of the body 141 of the heat sink fin 140.

For example, in this case, the proximal end 125 includes a base plate 121, an angled extension 123 that extends from the base plate 121, and a termination section 124 disposed at the end of the angled extension 123. The presence, shape, and/or size of each of the features can vary based on one or more of a number of factors, including but not limited to the configuration of each heat sink assembly 120, the number of heat sink assemblies 120, the configuration of the portions of the housing 180 that abut against and/or couple to the proximal end 125, and the configuration of the portions of the power supply housing 185 that abut against and/or couple to the proximal end 125.

The proximal end 125 can include one or more of a number of coupling features 122 for coupling to another component of the light fixture 100. For example, in this case, the proximal end 125 has two coupling features 122 that are apertures disposed in the angled extension 123. In such a case, one or more fastening devices (e.g., screws, bolts, rivets) can be disposed in the coupling features 122 as well as corresponding coupling features (e.g., apertures) in the power supply housing 185.

In certain example embodiments, the base 130 of the heat sink assembly 120 has a body 131 and any of a number of features and/or components. For example, the base 130 of the heat sink assembly 120 couples, directly or indirectly, to the heat sink fin 140 and abuts against a bottom side of the body 141 of the heat sink fin 140. For this to occur, the body 131 of the base 130 can include a number of coupling features (hidden from view by coupling features 143 of the heat sink fin 140) that complement the coupling features 143 of the heat sink fin 140. For example, such coupling features of the base 130 can be apertures with threaded walls that traverse some or all of the thickness of the body 131 of the base 130. As another example, the heat sink fin 140 and the base 130 can be welded, glued, pressure fitted, or similarly coupled to each other.

As another example, the body 131 of the base 130 can include a number of coupling features 188 that allow the lighting panels 111 to couple to the base 130. In this case, the coupling features 188 are threaded apertures that traverse some or all of body 131 of the base 130 from the bottom of the base 130. In such a case, each of the light panels 111 can have one or more complementary coupling features (e.g., apertures) that, directly or indirectly, couple with the coupling features 188 in the body 131 of the base 130.

As yet another example, the body 131 of the base 130 can have one or more channels 132 that traverse some or all of the body 131 of the base 130. In this case, there are two channels 132 that traverse the width of the body 131 of the base 130. Each channel 132 can serve one or more of a number of purposes. For example, each channel 132 can provide structural support for the base 130, and so for the heat sink assembly 120. As another example, each channel 132 can be used to receive one or more electrical conductors (e.g., wires, cables) used to provide power, control, and/or communication between the light panels 111 and some other component (e.g., power supply, controller) of the light fixture 100.

As yet another example, the body 131 of the base 130 can include one or more of a number of coupling features that allow the base 130 of one heat sink assembly to couple to the base 130 of an adjacent heat sink assembly 120, thereby enabling a modular capability for the heat sink assembly 120. In this example, such coupling features are disposed along both sides of the body 131 of the base 130 along the entire length of the body 131 of the base 130.

As shown in FIGS. 2A and 2D, along one side of the body 131 of the base 130, there is a relatively narrow recess 134 disposed toward the top (adjacent to the distal end 129) and the bottom (adjacent to the proximal end 125) of the body 131 of the base 130, as well as a relatively wider recess 135 disposed in the middle between the recesses 134. Portions 158 of the body 131 of the base 130 appear as protrusions that form the recesses 134 and recess 135. One of the channels 132 is disposed between recess 135 and bottom recess 134, and the other channel 132 is disposed between recess 135 and top recess 134.

The other side of the body 131 of the base 130 in this example is a complementary mirror image of the opposite side of the body 131 of the base 130. Specifically, in this case, there is a wide recess 159 disposed toward (but not at) the top of the body 131 of the base 130, and an equally wide recess 159 disposed toward (but not at) the bottom of the body 131 of the base 130. Portions 136 of the body 131 of the base 130, one disposed at the top of the body 131 of the base 130 and the other disposed at the bottom of the body 131 of the base 130, as well as portion 137 of the body 131 of the base 130 disposed at the middle of the body 131 of the base 130, appear as protrusions that form the recesses 159.

Since the recesses (e.g., recess 159, recess 135) along one side of the body 131 of a base 130 substantially exactly complements (e.g., in terms of length, height, and width) the non-recessed portions (e.g., portion 158, portion 137) along the opposing side of the body 131 of a base 130, one base 130 can be coupled to another base 130 side-by-side to allow for modular growth or reduction in the size of the heat sink assembly 120. These various portions and/or recesses along the left and right sides of the body 131 of a base 130 can include one or more additional coupling features (e.g., tabs, detents, slots apertures) that allow one base 130 to become coupled, directly or indirectly, to another base 130. While these coupling features for modularity are shown along the left and right sides of a base 130, such coupling features can be located, additionally or alternatively, along the top side, the bottom side, top surface, and/or bottom surface of the body 131 of a base 130.

As yet another example, the body 130 can include one or more electrical features disposed therein and/or thereon. In this case, the body 131 of the base 130 has a number of electrically-conductive leads 138 disposed between electrically-conductive terminals 139. These leads 138 and/or terminals 139 can be disposed on an outer surface (e.g., a top surface) of the body 131 of the base 130. Alternatively, these leads 138 and/or terminals 139 can be embedded within the body 131 of the base 130. In certain example embodiments, one or more of the terminals 139 can be aligned with corresponding electrically-conductive terminals disposed in the body 141 of a heat sink fin 140 and/or a lighting panel 111. In such a case, when the base 130 is coupled to the heat sink fin 140 and/or the lighting panels 111, electrical continuity can be established between the base 130 and the heat sink fin 140 and/or the lighting panels 111.

The body 131 of the base 130 can have a width and a length. The length of the body 131 of the base 130 can be less than the length of the body 141 of the heat sink fin(s) 140, which helps to create the air gaps 189 discussed below. The width of the body 131 of the base 130 can be greater than the width of the body 141 of the heat sink fin(s) 140, which allows for a modular approach of coupling one heat sink assembly 120 side-by-side with another heat sink assembly 120 without causing any appreciable difference in spacing between adjacent heat sink fins 140.

In certain example embodiments, the base 130 avoids direct contact with the proximal end 125 and the distal end 129 of the heat sink assembly 120. In such a case one or more air gaps 189 can be formed along the height of the heat sink fins 140 adjacent to the proximal end 125 and the distal end 129 of the heat sink assembly 120. If there is no part of the housing 180 or other component of the light fixture 100 that obstructs these air gaps 189, then the air gaps 189 can be used to allow for natural convection therethrough, thereby helping to dissipate heat generated by one or more components (e.g., a power supply, the lighting panels 111) of the light fixture 100.

Figure 3A:
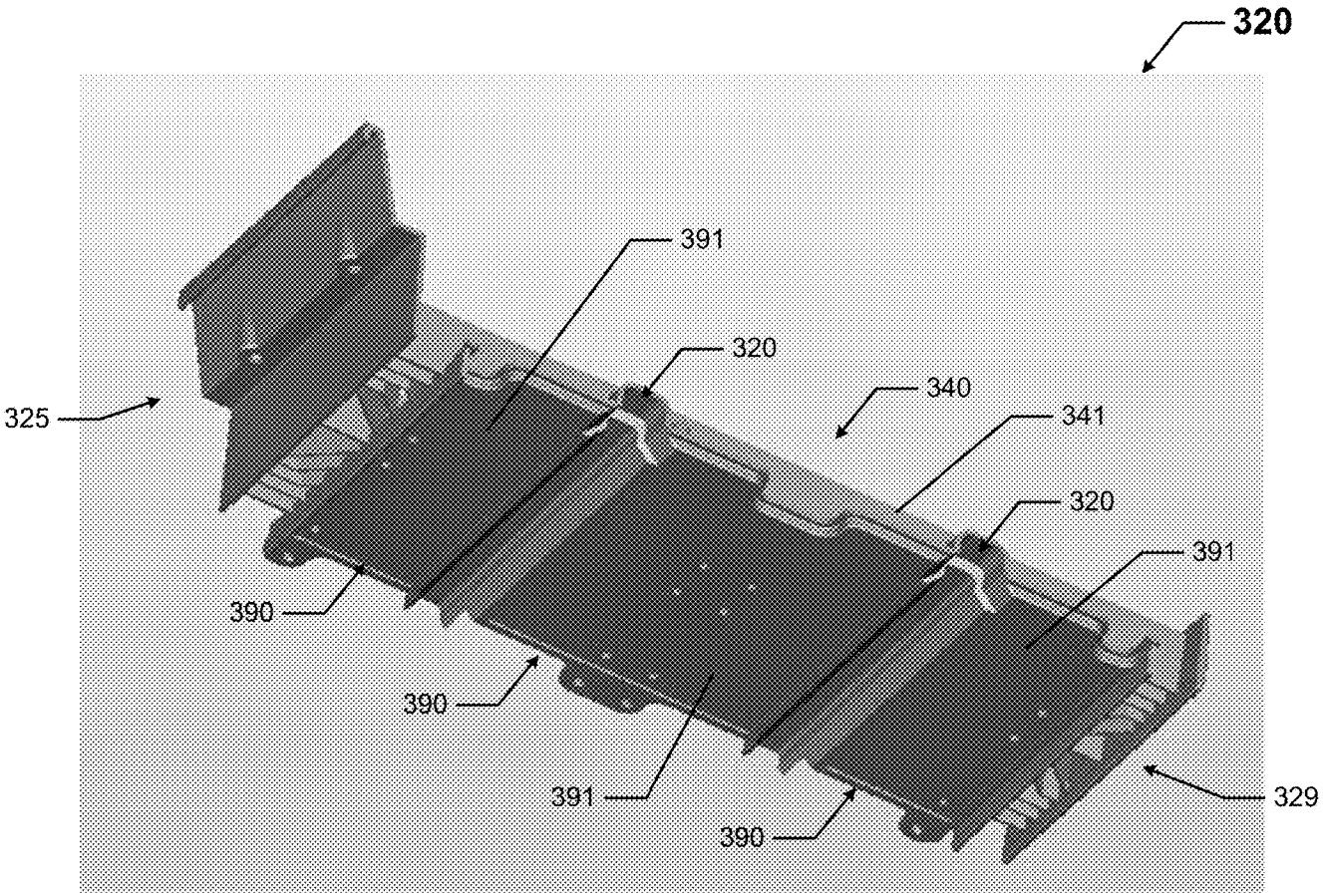
FIGS. 3A and 3B show various views of another heat sink assembly in accordance with certain example embodiments.
Figure 3B:
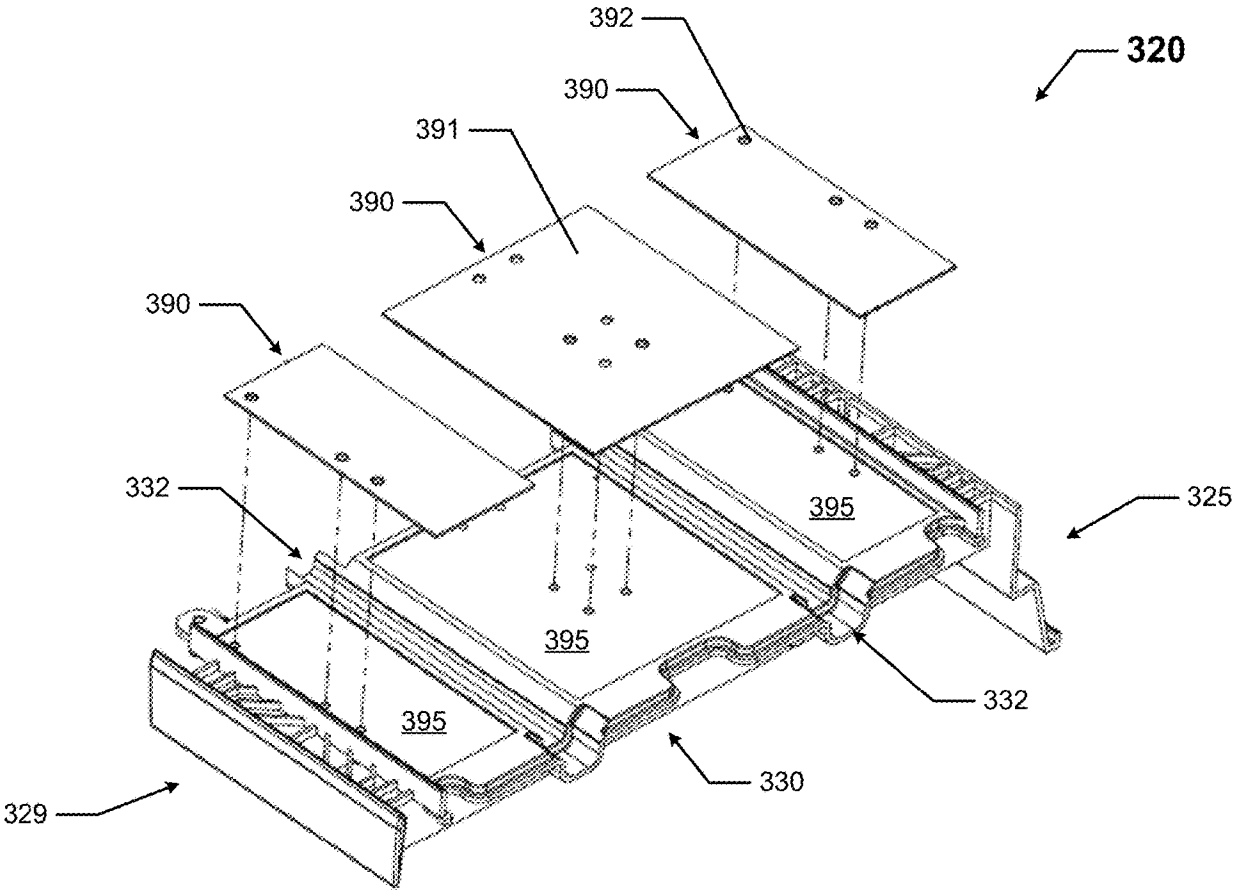

FIGS. 3A and 3B show another heat sink assembly 320 in accordance with certain example embodiments. Specifically, FIG. 3A shows a bottomfront-side perspective view of the heat sink assembly 320. FIG. 3B shows an exploded bottom-rear-side view of the heat sink assembly 320. Referring to FIGS. 1A-3B, the heat sink assembly 320 of FIGS. 3A and 3B is substantially similar to the heat sink assembly 120 of FIGS. 1A-2D, except as described below.

In this case, the base 330 of the heat sink assembly 320 includes one or more detachable plates 390. In this example, the plates 390 are coupled to a bottom surface 395 of the base 330, so that the plates 390 can come into contact with, or be located adjacent to, the lighting panels (e.g., lighting panels 111). In addition, or in the alternative, the plates 390 can be disposed at some other location of the base 330. Each plate 390 can have a body 391 that includes one or more coupling features 392 (in this case, apertures) for coupling the plate 390 to some other portion of the base 330. Each plate 390 can be made of one or more of any number of materials (e.g., thermoplastic, aluminum). When the base 330 includes plates 390, the plates 390 can cover all or a portion of one or more surfaces of the base 330. For example, in this case, there are three plates 390 that cover the entire bottom surface of the base 330 except for where the two channels 332 are disposed and where the features (e.g., recess 359, portion 358) for promoting modularity among other heat sink assemblies are disposed.

Figure 4A:
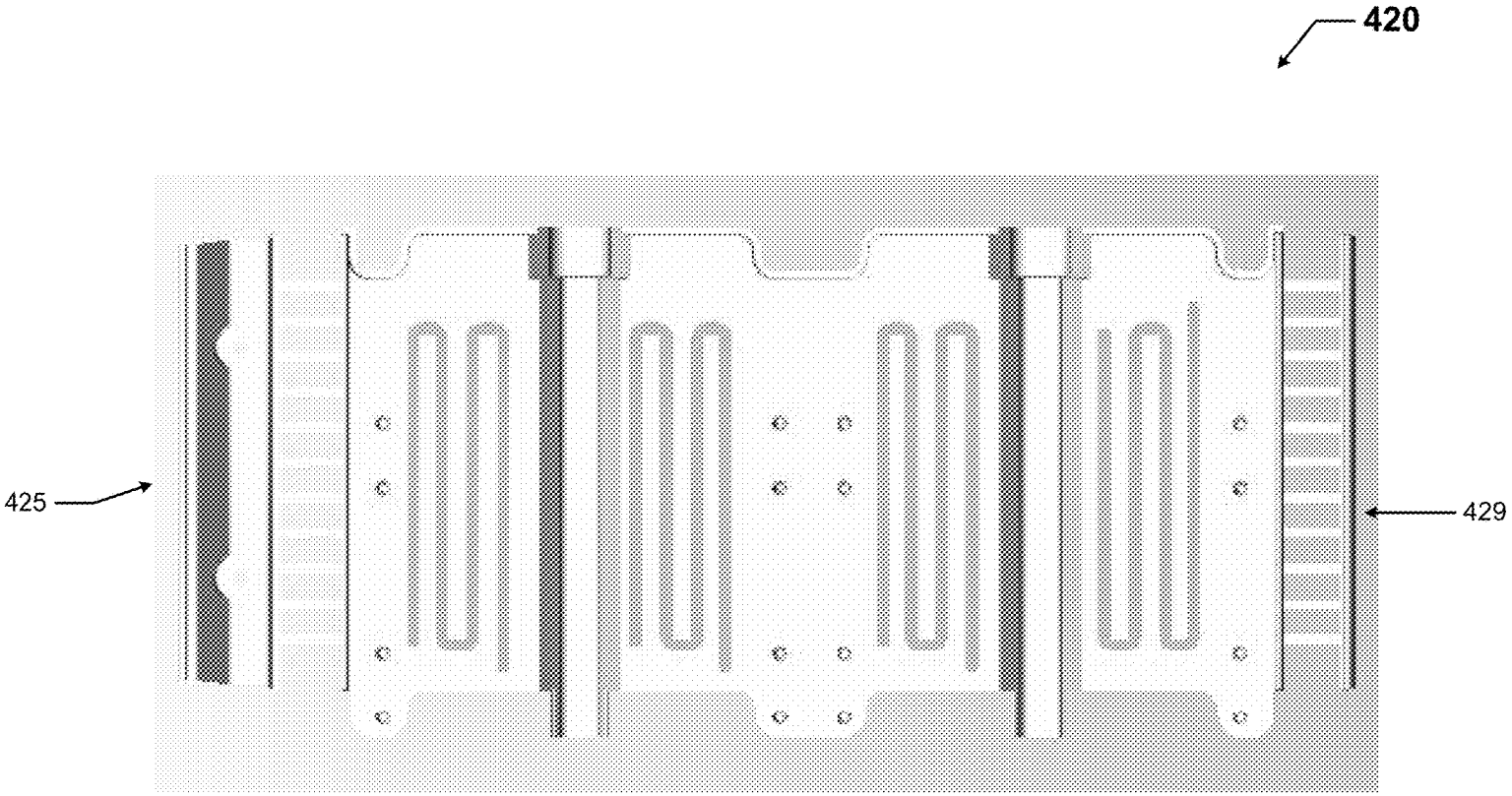
FIGS. 4A and 4B show yet another heat sink assembly in accordance with certain example embodiments.
Figure 4B:
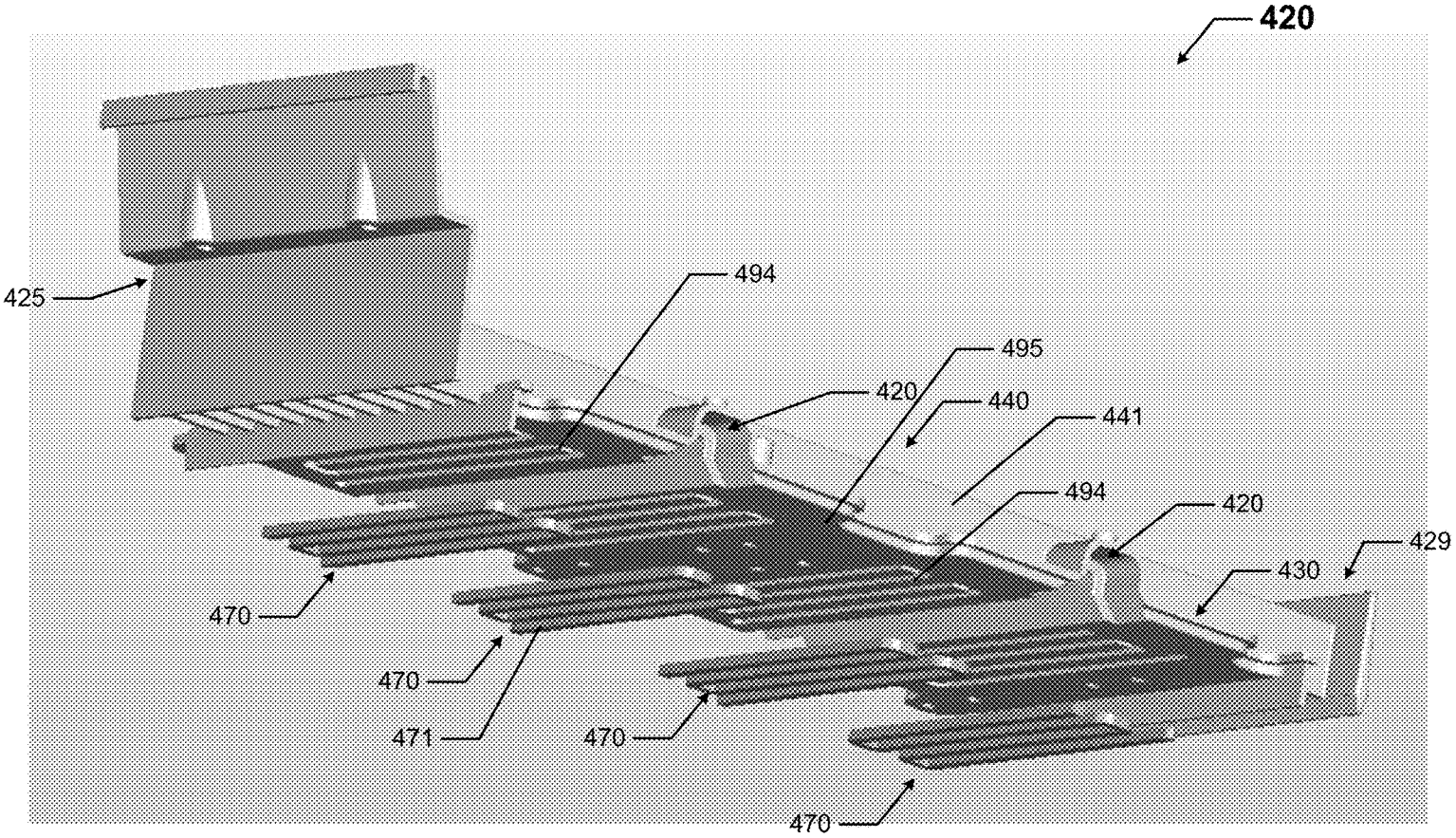

FIGS. 4A and 4B show various views of yet another heat sink assembly 420 in accordance with certain example embodiments. Specifically, FIG. 4A shows a bottom view of the heat sink assembly 420. FIG. 4B shows an exploded bottom-side-front perspective view of the heat sink assembly 420. Referring to FIGS. 1A-4B, the heat sink assembly 420 of FIGS. 4A and 4B is substantially similar to the heat sink assemblies of FIGS. 1A-3B, except as described below.

In this case, the base 430 of the heat sink assembly 420 includes one or more recesses 494 disposed in a surface of the body 431 of the base 430. In this example, the recesses 494 are disposed in a bottom surface 495 of the body 431 of the base 430, adjacent to where the lighting panels (e.g., lighting panels 111) are located when the lighting panels are coupled to the base 430. In addition, or in the alternative, the recesses 494 can be disposed at some other location of the base 430. Each recess 494 can have any shape (e.g., serpentine, circular cross-sectional shape) and size. The shape and size of each recess 494 is designed to receive a heat pipe 470, or a portion thereof.

Each heat pipe 470 has a body 471 that is made of one or more of any number of materials (e.g., plastic, polymeric material). When the base 430 includes heat pipes 470 disposed in the recesses 494, the heat pipes 470 can cover all or a portion of one or more surfaces of the base 430. The heat pipes 470 can be hollow or solid. When hollow, a heat pipe 470 can carry a fluid (e.g., air, water) that can remain stationary within the heat pipe 470 or be circulated through the heat pipe 470.

In some cases, the heat pipes 470 disposed in one heat sink assembly 420 can extend over and couple to the heat pipes 470 disposed in the adjacent heat sink assembly 420, forming one or more longer, continuous heat pipes 470. In such a case, one or more of the heat pipes 470 can be attached to one or both end caps (e.g., end cap 181) of the housing (e.g., housing 180). When this occurs, heat absorbed by the heat pipes 470 (including any fluid therein) can be transferred to the end caps to facilitate more rapid removal of heat from the heat-generating components (e.g., power supply, light sources and electronics of the lighting panels) from the light fixture.

Figure 5A:
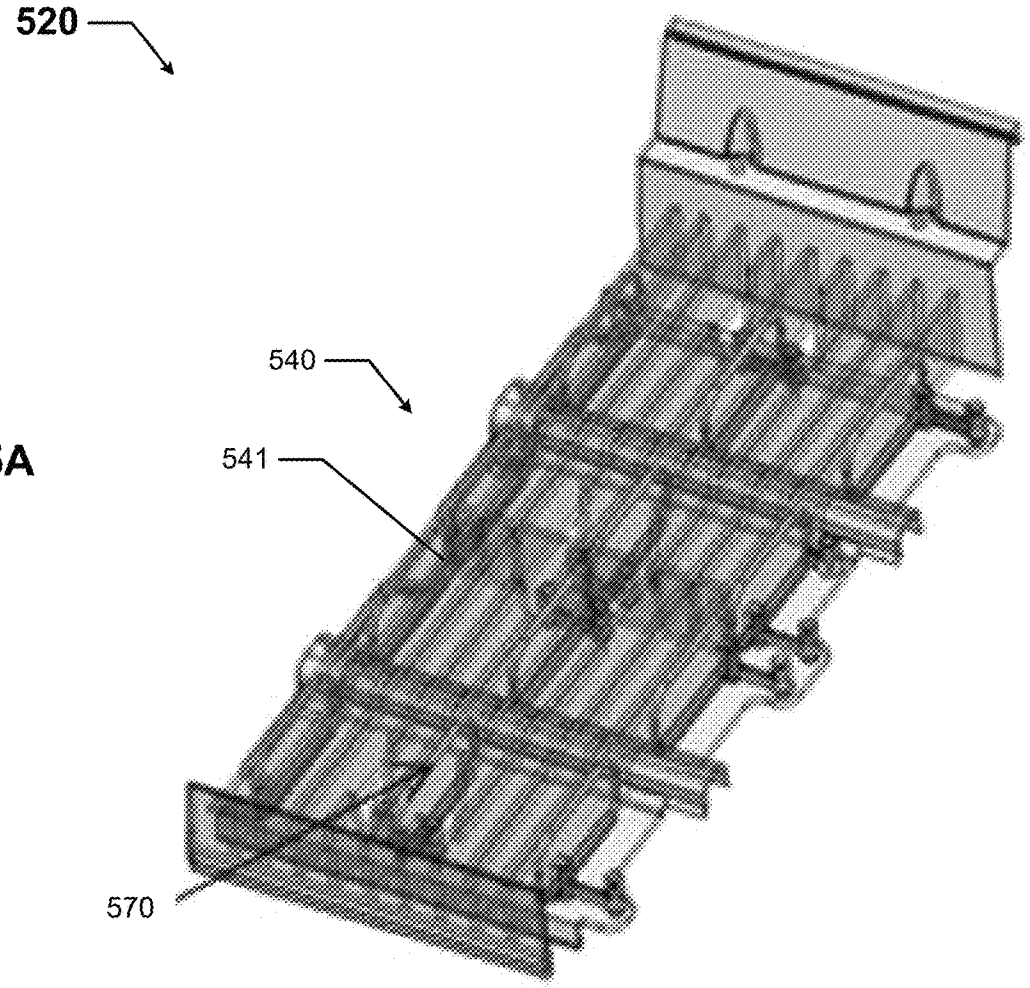
FIGS. 5A-5C show various views of a heat sink assembly with heat pipes embedded therein in accordance with certain example embodiments.
Figure 5B:
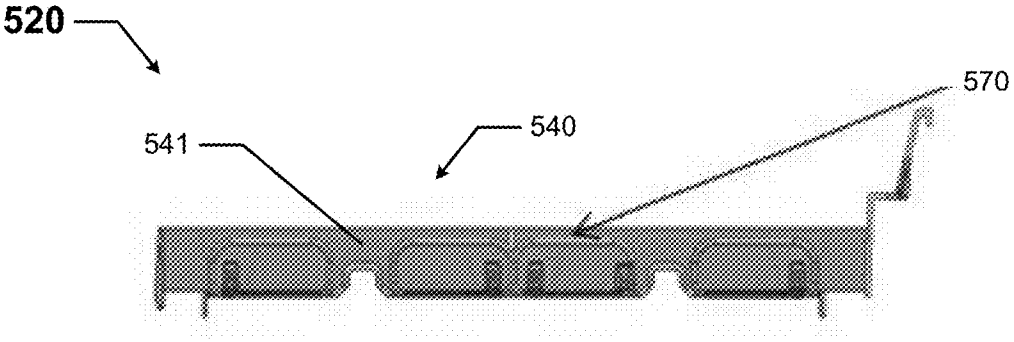
Figure 5C:
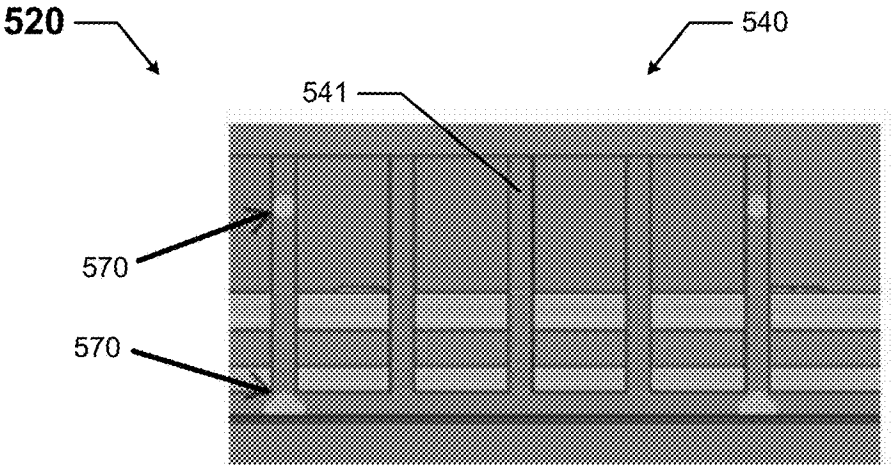

FIGS. 5A-5C show various views of a heat sink assembly 520 with heat pipes embedded therein in accordance with certain example embodiments. Specifically, FIG. 5A shows a transparent top-rear-side perspective view of the heat sink assembly 520. FIG. 5B shows a side view of a heat sink fin 540. FIG. 5C shows a cross-sectional front view of the heat sink assembly 520. Referring to FIGS. 1A-5C, the heat sink assembly 520 (including components thereof) of FIGS. 5A-5C are substantially the same as the heat sink assemblies (including components thereof and/or other components of the light fixtures) of FIGS. 1A-4B, except as described below. In this case, there are heat pipes 570 embedded within the body 541 of one multiple heat sink fins 540 of the heat sink assembly 520. This configuration can help dissipate heat absorbed by the heat sink fins 540 more efficiently.

Figure 6:
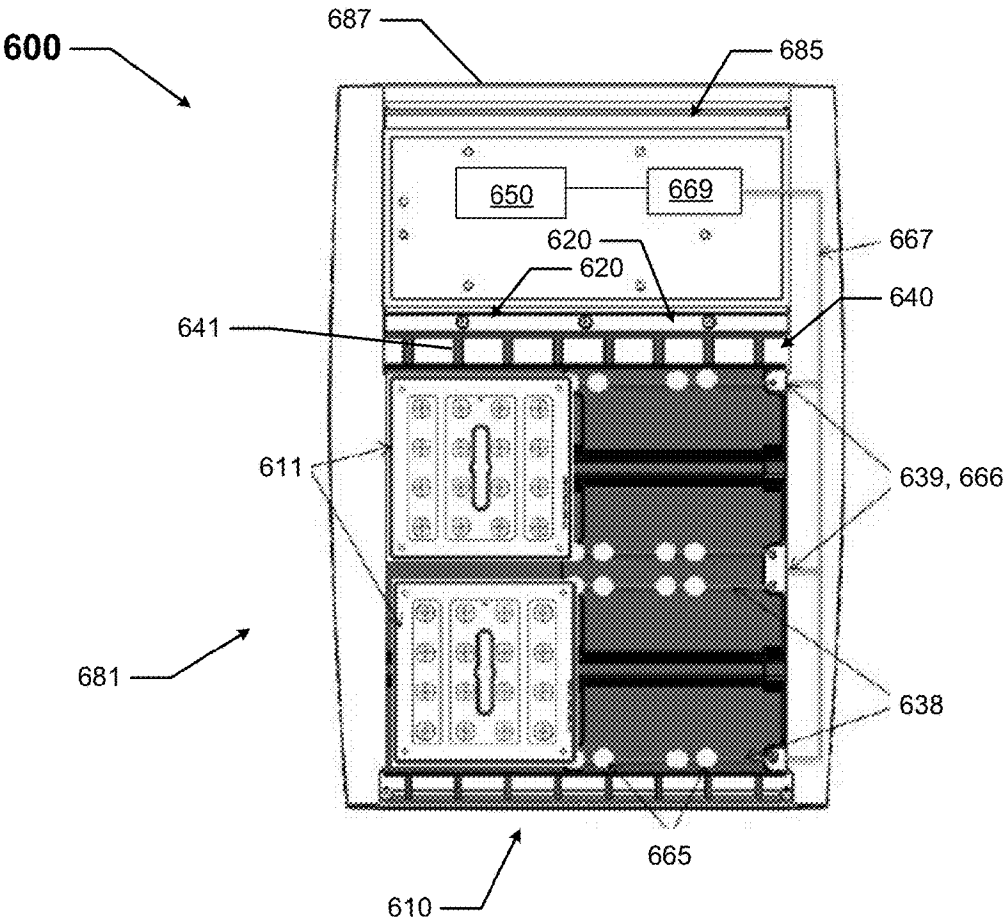
FIG. 6 shows a light fixture with embedded wiring in the heat sink assemblies in accordance with certain example embodiments.

FIG. 6 shows a light fixture 600 with embedded wiring in the heat sink assemblies 620 in accordance with certain example embodiments. Referring to FIGS. 1A-6, the light fixture 600 (including components thereof) of FIG. 6 is substantially the same as the light fixtures (including components thereof) of FIGS. 1A-5C, except as described below. In this case, one or more electrically-conductive studs 665 are embedded into the body 641 of one or more heat sink fins 640 of a heat sink assembly 620. These studs 665 can be made of one or more of a number of electrically-conductive materials (e.g., brass, copper, aluminum). In some cases, a stud 665 can be inserted into and/or removed from the heat sink fins 640 by a user.

These studs 665 can be connected to leads 638 within the body 641 of a heat sink fin 640, as well as to a lighting panel 611. In this way, power generated by the power supply 669 can be sent through electrical wiring 667 and distributed to one or more connectors 666 within the housing, where these connectors 666 can be in contact with corresponding terminals 639 disposed on the base or some other portion of the heat sink assembly 620. The power can then continue to flow from the terminals 639 through the leads 638 within the body 641 of a heat sink fin 640, through the studs 665, and end at the lighting panels 611 of the lighting assembly 610. By having the circuitry embedded in the heat sink assemblies 620, efficiencies can be gained through reduced material, simpler design, and ease of maintenance.

In some cases, a stud 665 can serve some purpose other than transceiving (sending and/or receiving) power and/or control signals. For example, a stud 665 can be a sensor (e.g., a temperature sensor) disposed within the heat sink assembly 620, and the stud 665 can transceive data signals. In such a case, the stud 665 serving as a sensor can be disposed in any part of the heat sink assembly 620, including but not limited to the base, the body of a heat sink fin, the distal end, and the proximal end. The stud 665 can be completely embedded within or protrude from the heat sink assembly 620. In this way, all of a sensor or only a portion of a sensor can be in physical contact with the heat sink assembly 620. If a stud 665 is a sensor, stud 665 can be coupled to the controller 650, and the measurements taken can be sent to the controller 650. Similarly, the controller 650 can control the sensor capability of the stud 665.

In such cases, this arrangement between the controller 650, the power supply 669 of the light fixture 600, and the studs 665 serving as sensors can allow for real-time control to regulate one or more parameters (e.g., temperature, current, voltage, relative humidity) within some or all of the light fixture 600, thereby helping to ensure the reliability and operational longevity of the light fixture 600 and its various components. For example, if one or more studs 665 embedded in portions of the heat sink assembly 620 serve as sensors and are coupled to a particular lighting panel, the studs 665 can measure elevated temperatures (e.g., above a threshold value). The studs 665 can then send these measurements to the controller 650, where the controller 650 can instruct the power supply 669 of the light fixture 600 to reduce the current delivered to that lighting panel 611, thereby reducing the temperature at which the lighting panel 611 operates.

FIG. 6 also shows a controller 650 disposed within the power supply housing 685. The controller 650 can be coupled to the power supply 669 and provide control over one or more components of the light fixture 600, including the power supply 669. The controller 650 can also communicate with (e.g., send signals to, receive signals from) some other device in a lighting system. Such a device can include, but is not limited to, a user device, a controller of another light fixture in the lighting system, a master controller, and a network manager. In such a case, the controller 650 can communicate using wired and/or wireless technology.

The controller 650 can be autonomous, self-learning, reporting, controlled by a user, controlled by a network manager, and/or operate in any of a number of other modes. In certain example embodiments, the controller 650 can include one or more of a number of components. Examples of such components can include, but are not limited to, a control engine, a communication module, a timer, a power module, an energy measurement module, a storage repository (which can include, for example, threshold values, stored data, protocols, and algorithms), a hardware processor, a memory, a transceiver, an application interface, and a security module. The controller 650 can correspond to a computer system.

In certain example embodiments, the controller 650 includes a hardware processor. Alternatively, the controller can include, as an example, one or more field programmable gate arrays (FPGA), one or more insulated-gate bipolar transistors (IGBTs), and one or more integrated circuits (ICs). Using FPGAs, IGBTs, ICs, and/or other similar devices known in the art allows the controller (or portions thereof) to be programmable and function according to certain logic rules and thresholds without the use of a hardware processor. In some cases, FPGAs, IGBTs, ICs, and/or other similar devices can be used in conjunction with one or more hardware processors.

As discussed above, the controller 650 can communicate with another component (e.g., a user device, a controller of another light fixture in the lighting system, a master controller, a network manager) using wired and/or wireless technology. The controller 650 can facilitate this communication using a transceiver. The transceiver of the controller 650 can send and/or receive control and/or communication signals. Specifically, the transceiver can be used to transfer data between the controller 650 and other components of a lighting system. The transceiver can be configured in such a way that the control and/or communication signals sent and/or received by the transceiver can be received and/or sent by another transceiver that is part of another component of a lighting system.

When the transceiver uses wireless technology, any type of wireless technology can be used by the transceiver in sending and receiving signals. Such wireless technology can include, but is not limited to, Wi-Fi, visible light communication, cellular networking, Bluetooth, and Bluetooth Low Energy. The transceiver can use one or more of any number of suitable communication protocols (e.g., ISA100, HART) when sending and/or receiving signals. Such communication protocols can be dictated by a communication module of the controller 650. Further, any transceiver information for other components in the system can be stored in a storage repository of the controller 650.

Figure 7A:
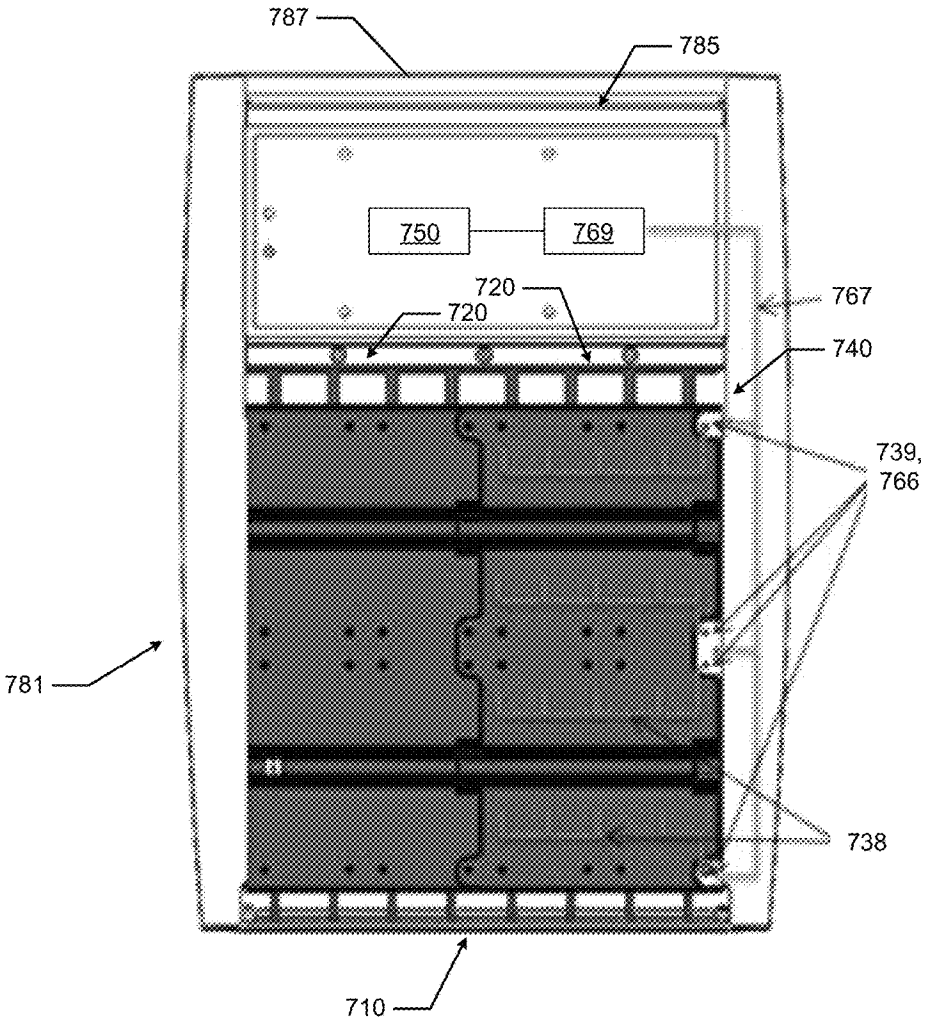
FIGS. 7A-7C show another light fixture with embedded wiring in the heat sink assemblies in accordance with certain example embodiments.
Figure 7C:
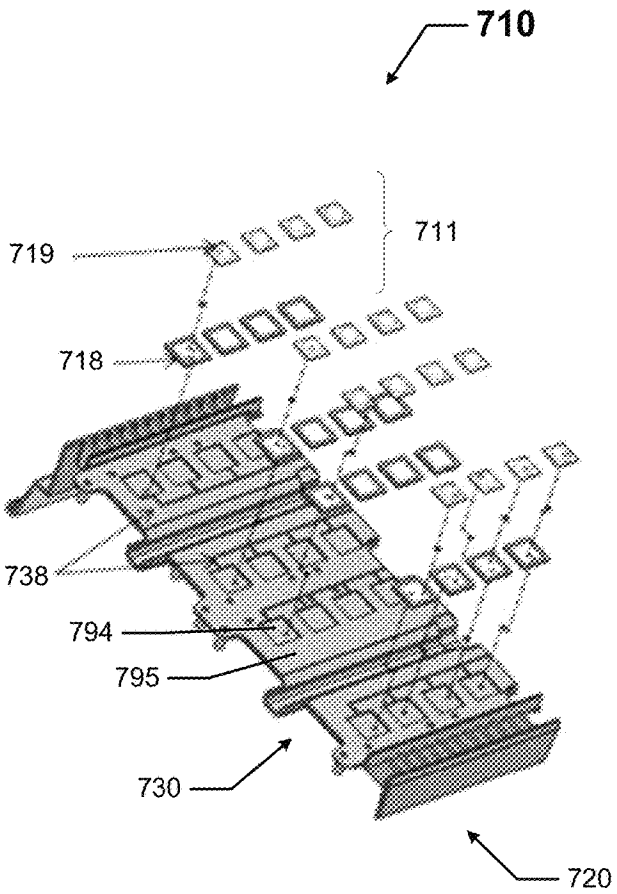
Figure 7B:
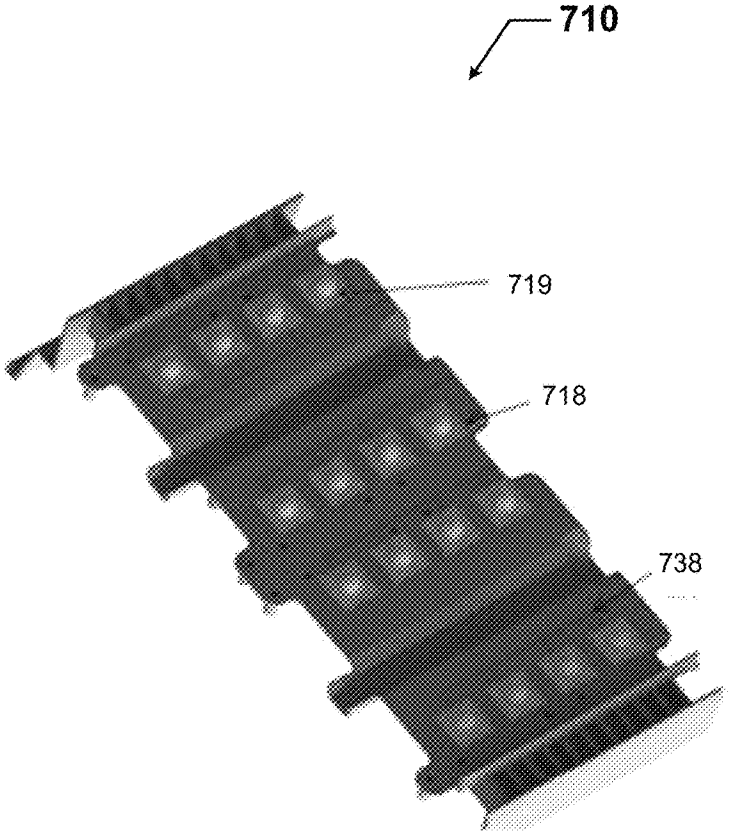

FIGS. 7A-7C show another light fixture 700 with embedded wiring in the heat sink assemblies in accordance with certain example embodiments. Specifically, FIG. 7A shows a partial bottom view of the light fixture 700. FIG. 7B shows a bottom-side perspective view of the light assembly 710 of the light fixture 700. FIG. 7C shows an exploded bottom-side perspective view of the light assembly 710 of the light fixture 700. Referring to FIGS. 1A-7C, the light fixture 700 (including components thereof) of FIGS. 7A-7C is substantially the same as the light fixtures (including components thereof) of FIGS. 1A-6, except as described below. In this case, the leads 738 are embedded in the bottom surface 795 of the base 730 of the heat sink assembly 720, which can be in addition to or in the alternative of embedding the leads 738 into the body of the heat sink fins.

Also, the lighting panels 711 are much smaller and more numerous relative to the lighting panels discussed above. In this case, each lighting panel 711 includes a light source 719 (e.g., a LED) and a mounting platform 718 for the light source 719. The lighting panels 711 of FIGS. 7A-7C can be individually plugged into dedicated recesses 794 (e.g., sockets) in the bottom surface 795 of the base 730 of the heat sink assembly 720. As with the light fixture 600 of FIG. 6, this design eliminates electrical wiring used to connect the lighting panels 711 with the power supply 769. Further, individual lighting panels 711 can safely be removed from the light fixture 700 and/or installed in the light fixture 700 without having to disrupt electrical service to the other lighting panels 711. Further, because of the relatively large number of lighting panels 711 in the light fixture 700, having a small number of lighting panels 711 out of service at any point in time will not appreciably detract from the overall light output of the light fixture 700.

FIG. 7A also shows a controller 750 disposed within the power supply housing 785. The controller 750 of FIG. 7A can be substantially the same as the controller 650 described above with respect to FIG. 6. For example, the controller 750 in this case is coupled to the power supply 769 and provides control over one or more components of the light fixture 700, including the power supply 769. The controller 750 can also communicate with (e.g., send signals to, receive signals from) some other device in a lighting system.

In one or more example embodiments, example heat sinks can be used to use thermoplastic material that is lighter and less expensive than existing heat sinks, and yet still dissipates sufficient heat to comply with industry standards (e.g., UL standards). Further, example heat sink assemblies can have embedded therein electrical leads that can be used to transfer power, control, and/or communication signals between the light sources of the light fixture and one or more other components (e.g., power supply, controller) of the light fixture. Using example embodiments described herein can improve safety, maintenance, costs, and operating efficiency.

Accordingly, many modifications and other embodiments set forth herein will come to mind to one skilled in the art to which example embodiments pertain having the benefit of the teachings presented in the foregoing descriptions and the associated drawings. Therefore, it is to be understood that example embodiments are not to be limited to the specific embodiments disclosed and that modifications and other embodiments are intended to be included within the scope of this application. Although specific terms are employed herein, they are used in a generic and descriptive sense only and not for purposes of limitation.

What is claimed is:

1. A heat sink assembly for a light fixture, the heat sink assembly comprising:

at least one heat sink fin disposed in thermal communication with at least one heat-generating component of the light fixture, wherein the at least one heat sink fin comprises a thermally conductive plastic;

a base having a top surface and a bottom surface, wherein the at least one heat sink fin is disposed on the top surface of the base; and at least one plate detachably coupled to the bottom surface of the base, wherein the at least one plate comprises a thermally conductive material, wherein the at least one heat sink fin absorbs and dissipates sufficient heat to comply with applicable industry standards for the light fixture.

2. The heat sink assembly of claim 1, wherein the at least one plate comprises at least one coupling feature that is configured to couple to at least one lighting panel.

3. The heat sink assembly of claim 2, wherein the base comprises a body in which at least one electrical lead is embedded, wherein the at least one electrical lead provides power from a power supply of the light fixture to the at least one lighting panel.

4. The heat sink assembly of claim 2, wherein the at least one lighting panel is a plurality of lighting panels, wherein the base comprises a plurality of recesses in which the plurality of lighting panels is disposed, wherein the plurality of lighting panels, when disposed in the plurality of recesses, receives power to operate, wherein one lighting panel of the plurality of lighting panels can be removed without disrupting operation of a remainder of the plurality of lighting panels.

5. The heat sink assembly of claim 1, wherein the base comprises the thermoplastic material.

6. The heat sink assembly of claim 1, further comprising:

at least one heat pipe disposed in the bottom surface of the base.

7. The heat sink assembly of claim 1, wherein the base comprises at least one channel that traverses its width.

8. The heat sink assembly of claim 1, wherein the base comprises at least one feature that is configured to complement at least one complementary feature of another heat sink assembly when the another heat sink assembly is disposed next to the base.

9. The heat sink assembly of claim 8, wherein the at least one feature comprises a recess, and wherein the at least one complementary feature comprises a protrusion.

10. The heat sink assembly of claim 1, wherein the at least one heat sink fin has at least one heat pipe disposed therein.

11. The heat sink assembly of claim 1, wherein the base has a first length that is less than a second length of the at least one heat sink fin.

12. The heat sink assembly of claim 1, further comprising:

a proximal end coupled to the at least one heat sink fin, wherein the proximal end comprises at least one coupling feature for coupling to another portion of the light fixture.

13. The heat sink assembly of claim 1, wherein the at least one heat sink fin comprises at least one electrical lead embedded in a wall of the at least one heat sink fin, wherein the at least one electrical lead provides power from a power supply of the light fixture to at least one lighting panel.

14. The heat sink assembly of claim 1, wherein the at least one heat sink fin comprises at least one stud embedded in a wall of the at least one heat sink fin, wherein the at least one stud transceives signals.

15. The heat sink assembly of claim 14, wherein the at least one stud comprises a sensor.

16. The heat sink assembly of claim 15, wherein the sensor measures a temperature.

17. The heat sink assembly of claim 16, wherein the stud is configured to be communicably coupled to a controller, wherein the controller determines that the temperature measured by the sensor falls outside a range of acceptable values, wherein the controller adjusts an amount of current delivered by a power supply to a component of the light fixture located proximate to the sensor to bring the temperature within the range of acceptable values.

18. The heat sink assembly of claim 14, wherein the at least one stud is configured to deliver power from a power supply, through the at least one heat sink fin, to at least one lighting panel.

19. A heat sink assembly for a light fixture, the heat sink assembly comprising:

at least one heat sink fin disposed in thermal communication with at least one heat-generating component of the light fixture, wherein the at least one heat sink fin comprises a thermally conductive plastic;

a base having a top surface and a bottom surface, wherein the at least one heat sink fin is disposed on the top surface; and at least one heat pipe disposed on the bottom surface of the base, wherein the at least one heat pipe comprises a thermally conductive material.

20. A modular heat sink for a light fixture, the modular heat sink comprising:

a first heat sink assembly comprising a first base having a first left side and a first right side, wherein the first left side comprises at least one first recess having a first shape and a first size at a first location along the first left side, wherein the first right side comprises at least one first protrusion having a second shape and a second size at the first location along the first right side; and a second heat sink assembly comprising a second base having a second left side and a second right side, wherein the second left side comprises the at least one first recess having the first shape and the first size at the first location along the second left side, wherein the at least one first protrusion of the first right side of the first heat sink assembly is detachably disposed within the at least one first recess of the second left side of the second heat sink assembly when the first heat sink assembly and the second heat sink assembly are coupled to each other.

* * * * *